US009482241B2

(12) United States Patent
Locker, Jr. et al.

(10) Patent No.: US 9,482,241 B2
(45) Date of Patent: Nov. 1, 2016

(54) ACCESSIBLE BLOWER ASSEMBLY, BLOWER SLIDER ASSEMBLY, AND METHODS

(71) Applicants: Todd Robert Locker, Jr., Wexford, PA (US); Matthew W. Riggle, Ford City, PA (US)

(72) Inventors: Todd Robert Locker, Jr., Wexford, PA (US); Matthew W. Riggle, Ford City, PA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 728 days.

(21) Appl. No.: 13/906,910

(22) Filed: May 31, 2013

(65) Prior Publication Data

US 2014/0056695 A1 Feb. 27, 2014

Related U.S. Application Data

(60) Provisional application No. 61/693,511, filed on Aug. 27, 2012.

(51) Int. Cl.
*F04D 29/62* (2006.01)
*F04D 29/60* (2006.01)
*F04D 29/42* (2006.01)

(52) U.S. Cl.
CPC ..... *F04D 29/601* (2013.01); *F04D 29/4226* (2013.01); *F04D 29/626* (2013.01); *Y10T 29/49318* (2015.01)

(58) Field of Classification Search
CPC ..... F04D 29/601; F04D 29/626; Y10T 29/49318; F24F 2013/205; H05K 7/20; H05K 7/20172
See application file for complete search history.

(56) References Cited

U.S. PATENT DOCUMENTS 4,130,376 A * 12/1978 Dietsche ..... F04D 29/424 126/110 R
6,027,406 A 2/2000 Yazici

FOREIGN PATENT DOCUMENTS

CN 101315084 A 12/2008
FR 2864209 A1 6/2005
JP 2003214394 7/2003
JP 2006054250 * 2/2006 ..... H05K 7/20

OTHER PUBLICATIONS

Rollon Telescopic Rail catalog from Dec. 2009.*
PCT International Search Report mailed Dec. 10, 2013 corresponding to PCT International Application No. PCT/US2013/054662 filed Aug. 13, 2013 (9 pages).

* cited by examiner

*Primary Examiner* — Craig Kim
*Assistant Examiner* — Brian O Peters

(57) ABSTRACT

An easy-access blower assembly is disclosed. The blower assembly includes a blower enclosure, and a blower slider assembly mounted to the blower enclosure. The blower slider assembly has slider rails, each with a moveable rail and a stationary rail, a blower mounting plate coupled to each moveable rail of the slider rails, and a blower motor and fan assembly mounted to the blower mounting plate wherein the blower motor and fan assembly is adapted to slide out of the blower enclosure. Blower slider assemblies and methods of servicing a blower motor and fan assembly are also provided, as are other aspects.

21 Claims, 9 Drawing Sheets

ACCESSIBLE BLOWER ASSEMBLY, BLOWER SLIDER ASSEMBLY, AND METHODS

RELATED APPLICATIONS

This application claims priority to U.S. Provisional Patent Application Ser. No. 61/693,511 filed on Aug. 27, 2012, entitled "Front Access Blower," the disclosure of which is hereby incorporated by reference in its entirety herein.

FIELD

The invention relates generally to blowers for cooling of electrical component enclosures.

BACKGROUND

Metal, box-like enclosures are commonly used to contain certain electrical equipment such as voltage controllers. For example, medium-voltage controllers may operate at voltages from about 5 kV to 38 kV. Other sized controllers are in use. These enclosures may in some cases be ventilated, in that one or more blowers may act to cool an interior of the enclosure. Such equipment enclosures may include a blower assembly that is mounted on a top surface of the enclosure. To service such blower assemblies during maintenance intervals, such as when a motor or fan fails or are being inspected, the entire blower assembly must be removed and torn down. This may be very time and labor intensive operation.

Accordingly, improved methods of servicing such blower assemblies are desired.

SUMMARY

According to a first aspect, a blower assembly is provided. The blower assembly includes a blower enclosure, a blower slider assembly mounted to the blower enclosure, the blower slider assembly includes slider rails each including a moveable rail and a stationary rail, a blower mounting plate coupled to each moveable rail of the slider rails, and a blower motor and fan assembly mounted to the blower mounting plate wherein the blower motor and fan assembly is adapted to slide out of the blower enclosure.

According to another aspect, a blower slider assembly is provided. The blower slider assembly includes a rail anchor plate adapted to mount to a blower enclosure, a blower anchor plate, a blower mounting plate removably fastened to the blower anchor plate, slider rails each including a moveable rail and a stationary rail, each stationary rail fastened to the anchor plate, and each moveable rail fastened to the blower anchor plate, and a blower motor and fan assembly mounted to the blower mounting plate wherein the blower motor and fan assembly is adapted to slide relative to the rail anchor plate.

According to still another aspect, a method of servicing a blower motor and fan assembly is provided. The method includes providing a blower assembly, comprising a blower enclosure, a blower slider assembly mounted to the blower enclosure, the blower slider assembly including slider rails each having a moveable rail and a stationary rail, a blower mounting plate coupled to each moveable rail; and a blower motor and fan assembly mounted to the blower mounting plate, and sliding the blower motor and fan assembly on the slider rails to move the blower motor and fan assembly out of the blower enclosure.

Still other aspects, features, and advantages of the invention may be readily apparent from the following detailed description wherein a number of exemplary embodiments and implementations are described and illustrated, including the best mode contemplated for carrying out the invention. The invention may also be capable of other and different embodiments, and its several details may be modified in various respects, all without departing from the scope of the invention. Accordingly, the drawings and descriptions are to be regarded as illustrative in nature, and not as restrictive. The drawings are not necessarily drawn to scale. The invention covers all modifications, equivalents, and alternatives falling within the scope of the invention.

DETAILED DESCRIPTION

Reference will now be made in detail to the example embodiments of this disclosure, which are illustrated in the accompanying drawings. Wherever possible, the same reference numbers will be used throughout the drawings to refer to the same or like parts.

The aforementioned difficulties associated with servicing (e.g., checking and repairing) is addressed by one or more embodiments of the invention described herein. Accordingly, embodiments provide improved service access to the blower motor and fan assembly, such that can be rapidly checked or changed out. Embodiments of the present invention provide a blower assembly that allows front access for a blower motor and fan assembly (otherwise referred to as a "blower unit") and that features a "slide out" design. This "slide out" feature makes maintenance operations on the internal wear parts of the blower unit quicker and easier.

A conventional blower unit is an air pump that either injects or ejects air from a device (e.g., an electrical equipment enclosure or the like) for cooling. The blower unit consists of a frame and enclosure that houses one or more fans and electric motors. The structure of the blower unit does not usually contain any regular maintenance or wear parts; however, the blower motor, fan and/or mechanical dampers may require maintenance. Embodiments of the invention eliminate full removal and disassembly of the structure for maintenance as was undertaken in the prior art.

Further details of example embodiments of various aspects of the invention are described with reference to FIGS. 1-13 herein.

Figure 1:
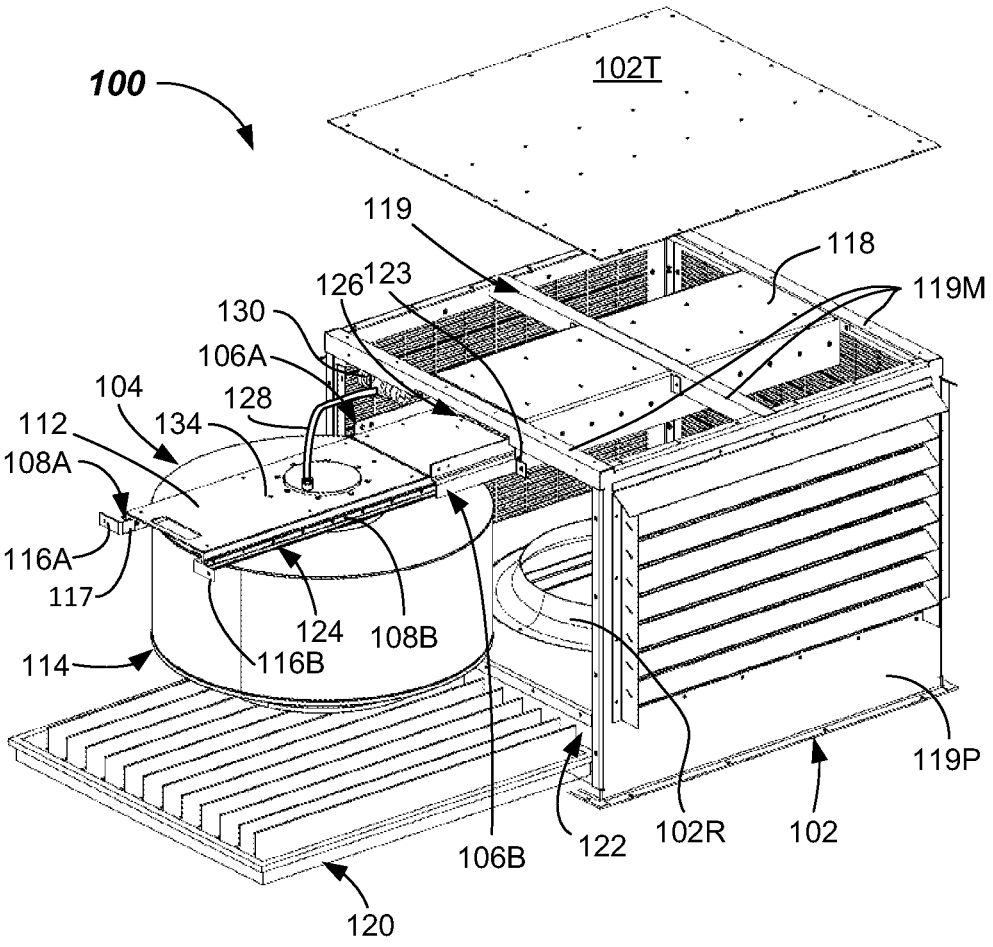
FIG. 1 illustrates a perspective view of a blower assembly, with the top removed, according to embodiments.

As shown in FIG. 1, a first embodiment of a blower assembly 100 is depicted. Blower assembly 100 includes a blower enclosure 102 and a blower slider assembly 104 mounted to the blower enclosure 102. Blower slider assembly 104 includes slider rails 106A, 106B, which may comprise linear bearings otherwise referred to as linear slides or linear rails. Linear rails available from Rollon of Hackettstown, N.J. may be used. Other types of linear slide mechanisms may be used. Each of the slider rails 106A, 106B includes a moveable rail 108A, 108B and a stationary rail 110A, 110B which are relative moveable relative to one another and may include ball bearings therein allowing smooth reciprocation there between. Blower assembly 100 further includes a blower mounting plate 112 coupled to each moveable rail 108A, 108B of the slider rails 106A, 106B, and a blower motor and fan assembly 114 mounted to the blower mounting plate 112. The coupling may be directly to the moveable rails 108A, 108B, or through an intermediate element. Blower motor and fan assembly 114 is adapted to slide out of the blower enclosure 102 to a location where it may be serviced (e.g., checked or exchanged). The blower motor and fan assembly 114 is mounted and fastened to the blower mounting plate 112, and the blower mounting plate 112 is mounted between the slider rails 106A, 106B in some embodiments. The blower motor and fan assembly 114 is mounted below the blower mounting plate 112 in the depicted embodiment.

Each of the stationary rails 110A, 110B may be mounted to a rail anchor plate 118. Rail anchor plate 118 is mounted or coupled to the blower enclosure 102, such as by suitable fasteners (e.g., bolts or screws). For example, the rail anchor plate 118 may be mounted to one or more frame members 119M of a frame 119. Mounting may be by tabs and fasteners, for example. Other fastening means may be employed.

In more detail, the blower motor and fan assembly 114 is mounted on slider rails 106A, 106B. When in operation, the blower motor and fan assembly 114 are kept secured in place by one or more security tabs 116A, 116B that bolt to the main structure, such as to the front of the rail anchor plate 118, or optionally to the frame 119. Security tabs 116A, 116B may be tabs formed on the blower mounting plate 112 or intermediate member, such as a blower anchor plate 117. To service the internal components, the front panel (not shown) of the blower enclosure 102 may first be removed. With the front panel removed, the user can immediately remove the damper 120 by sliding the damper 120 out of the damper channel 122. Accordingly, the damper 120 may be readily serviced.

To access the blower motor and fan assembly 114, the user may remove securing bolts (not shown) passing through security tabs 116A, 1166 and secured in captive nuts on securing tabs 123 which may be formed on the rail anchor plate 118. Rail anchor plate 118, slider rails 106A, 1066, and at least the blower mounting plate 112 make up a slider subassembly 105. The slider subassembly 105 may also include a blower anchor plate 117 in some embodiments. Once the securing bolts are removed, the blower motor and fan assembly 114 may slide out on the slider subassembly 105. The moveable slides 108A, 1086 of the slider subassembly 105 are allowed to slide (e.g., extend) to a certain point, and then some point, contact location, or feature on the slider subassembly 105 may be caught by a safety catch 126, not allowing further movement without user input. Safety catch 126 may be operational to limit an extent of sliding of the blower motor and fan assembly 114 out of the blower enclosure 102. Safety catch 126 may also lock the sliding of the blower motor and fan assembly 114 in a closed condition.

To completely remove the motor and blower fan assembly 114, the motor power cord 128 is disconnected by using the quick disconnect 130. The quick disconnect 130 is adapted to allow rapid disconnection of an electrical connection to the blower motor and fan assembly 114. The blower mounting plate 112 holding the blower fan assembly 114 is unbolted from a blower anchor plate 117. The blower fan assembly 114 can then be removed by lifting off from the blower anchor plate 117, such as with a crane or overhead hoist. The lifting may be accomplished by lifting provisions 134, such as bolt holes built in the blower mounting plate 112. Bolt holes may accept a lift adapter or eye bolts. Other types of lifting provisions 134 may be provided on the blower mounting plate 112. Optionally, the blower mounting plate 112 can be slid off onto a fork truck or other lifting jack. Offering front accessibility and sliding ability eliminates the need for complete removal/disassembly of the complete unit as in the prior art, and substantial time savings are afforded. Moreover, the slider subassembly 105 gives the user more options for positioning the blower mounting plate 112. Accordingly, one or more embodiments of the invention make maintenance operations easier.

Figure 2:
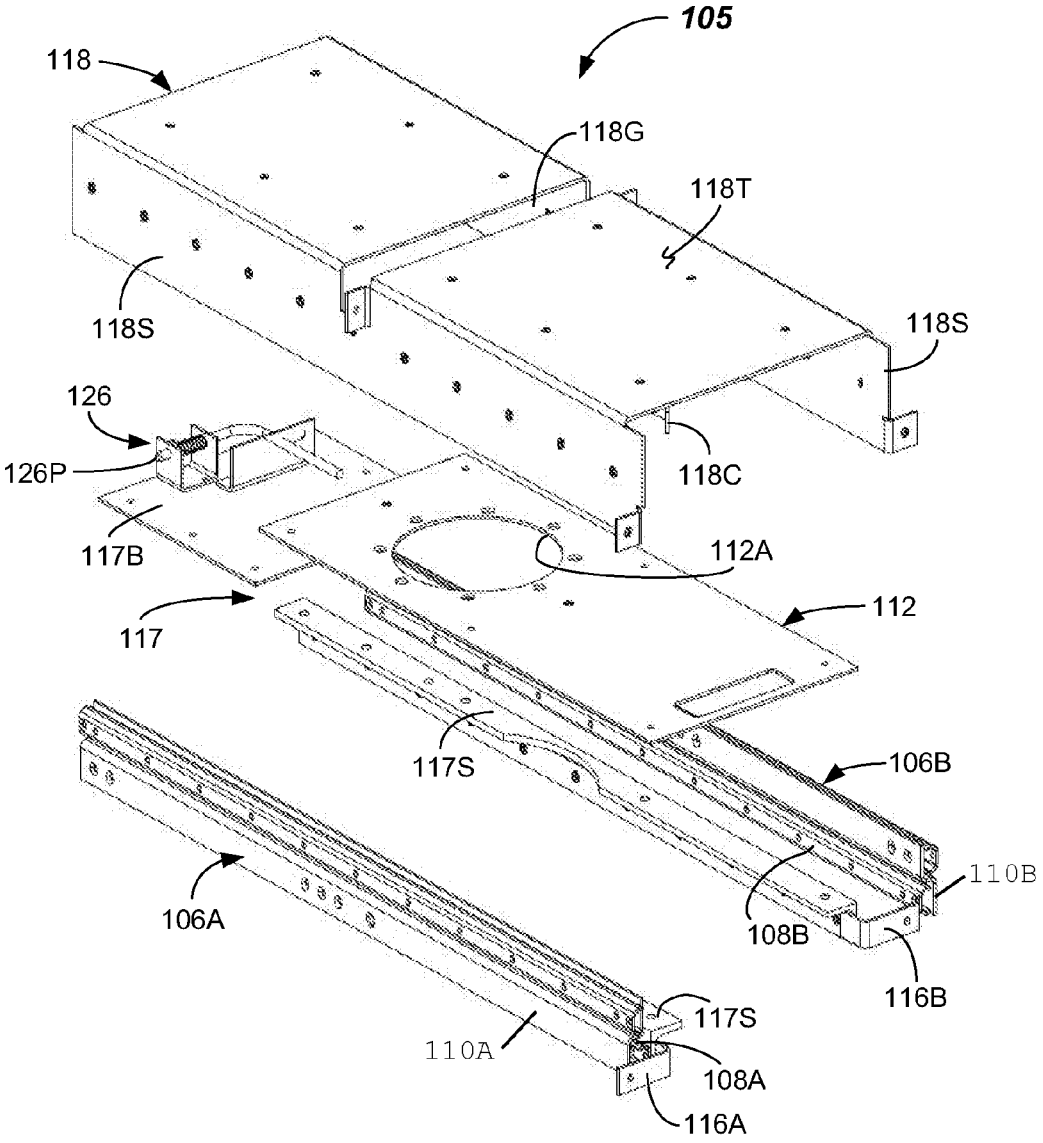
FIG. 2 illustrates an exploded perspective view of a blower slider assembly according to embodiments.
Figure 3:
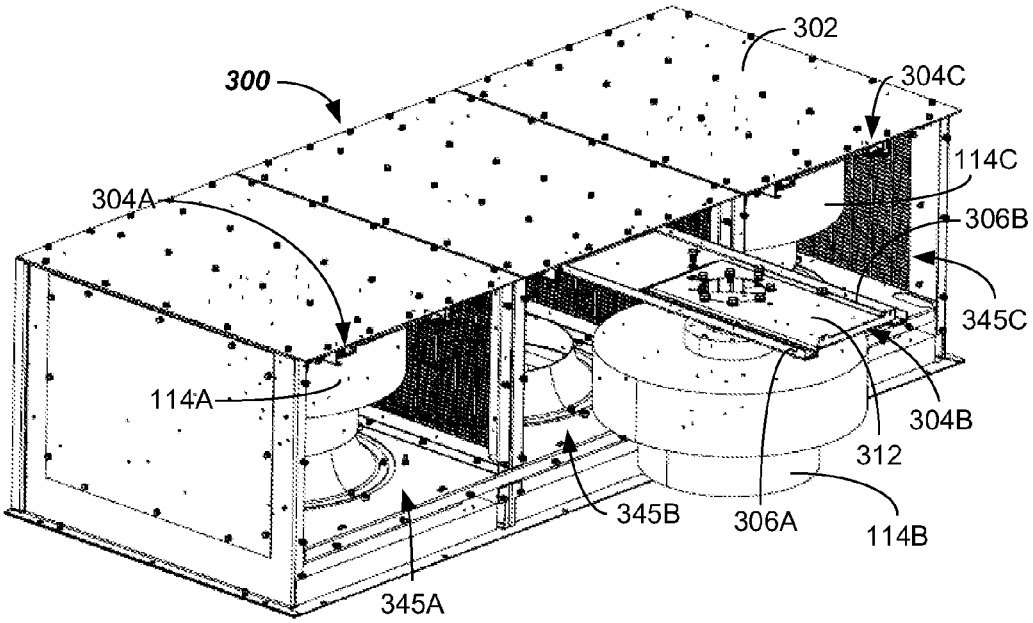
FIG. 3 illustrates a perspective view of a blower assembly including multiple blower slider assemblies according to embodiments.

Now referring to FIGS. 1 and 2, the structure of the slider subassembly 105 and blower enclosure 102 will be further described. In particular, the rail anchor plate 118 includes a top portion 118T, which may be received underneath a top 102T of the blower enclosure 102. The top portion 118T may be planar and fastened to the blower enclosure 102. The rail anchor plate 118 may include anchor sides 118S extending downward from the top portion 118T, wherein the stationary rails 110A, 110B are fastened to the anchor sides 118S. Rail anchor plate 118 may comprise a bent sheet metal plate or a weldment of several pieces. Rail anchor plate 118 may include a groove 118G adapted to receive a frame member 119M.

Also depicted in FIGS. 1 and 2 is a blower mounting plate 112 that is coupled to each moveable rails 108A, 108B of the slider rails 106A, 106B by a blower anchor plate 117. In the depicted embodiment, blower anchor plate 117 may include side portions 117S and a base portion 117B. Side portions 117S and base portion 117B may be fastened together by fasteners, such as bolts or screws (not shown) or may be formed integrally as one piece.

Blower mounting plate may be a sheet of plate steel or the like and a motor housing of the blower motor and fan assembly 114 may be received through an aperture 112A formed in the blower mounting plate 112. The blower mounting plate 112 is removably bolted to the blower anchor plate 117 such that the blower mounting plate 112 may be unbolted and the assembly of the blower mounting plate 112 and the motor and blower fan assembly 114 may be separated from the blower anchor plate 117. Separation may be by lifting or sliding the blower mounting plate 112 forward on the blower anchor plate 117.

The blower anchor plate 117 may further comprise a catch 126, such as a safety catch 126. Catch may comprise any suitable construction enabled to limit the extent of sliding of the blower mounting plate 112 out of the rail anchor plate 118. For example, a spring loaded catch pin 126P may be used. The catch pin 126P may be received in one or more appropriately positioned apertures, such as formed in on catch member 118C. The apertures may be positioned along the catch member 118C at various appropriate locations, such as to define the position of the motor and blower fan assembly 114 relative to the blower enclosure 102 when in an open (e.g., extended condition) or a closed (e.g., retracted, ready to operate condition) or in between. Thus, the blower fan assembly 114 may be locked out of the blower enclosure 102 in the opened condition, for example.

Figure 10:
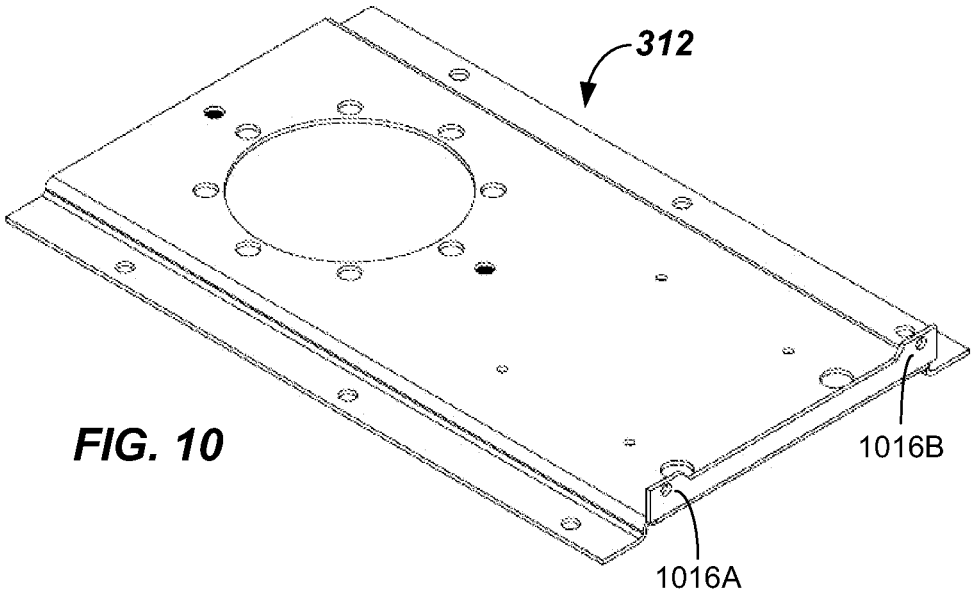
FIG. 10 illustrates a perspective view of a blower mounting plate according to embodiments.
Figure 11:
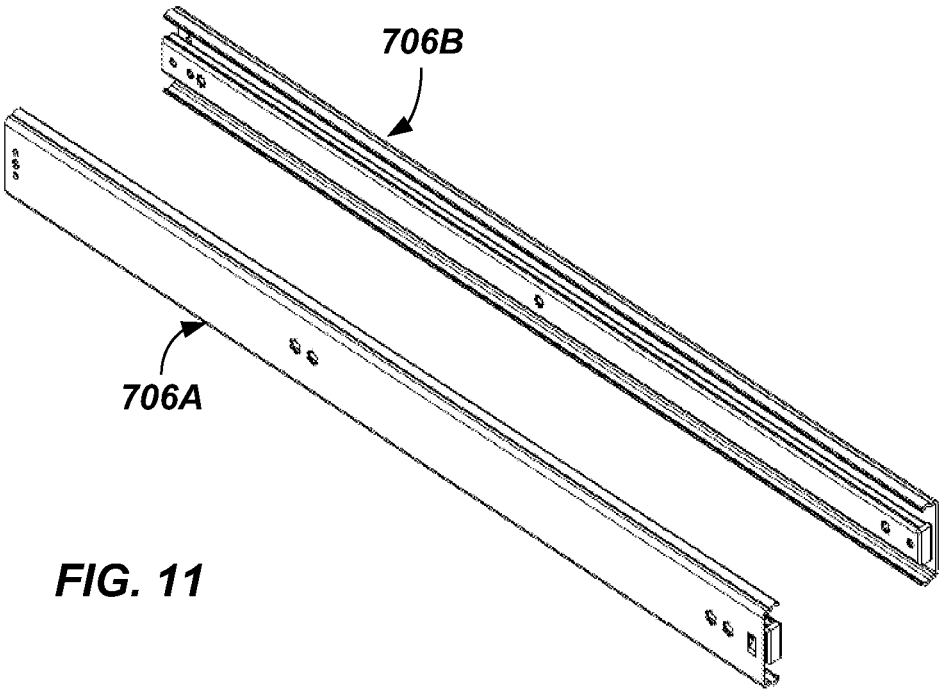
FIG. 11 illustrates a perspective view of slider rails according to embodiments.

The blower anchor plate 117 may comprise one or more securing tabs 116A, 116B adapted to secure the slider assembly 104 in a closed and secured condition within the blower enclosure 102. Optionally, the securing tabs may be provided on the blower mounting plate 112, such as shown in FIG. 10. The one or more securing tabs 116A, 116B are adapted to secure the blower mounting plate 112 or the blower anchor plate 117 to a rail anchor plate 118.

Figure 13:
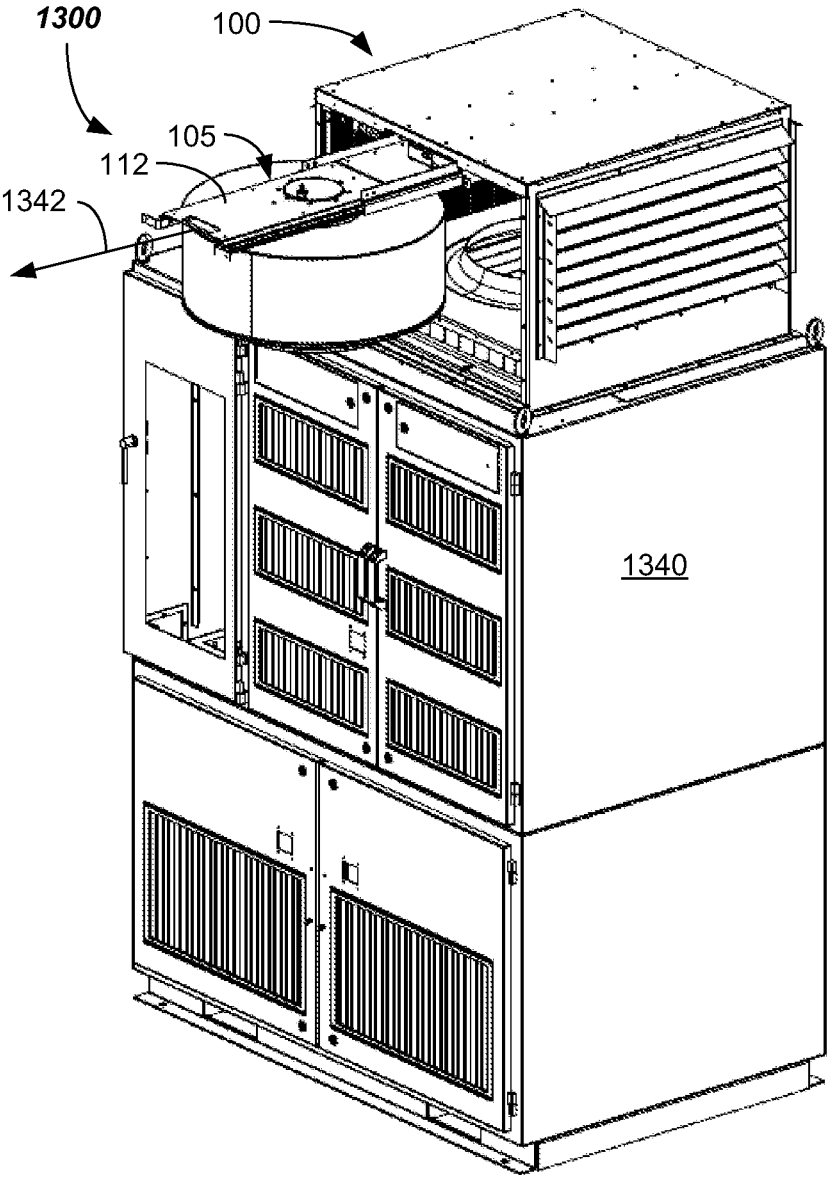
FIG. 13 illustrates a cooled equipment cabinet including the blower assembly mounted on top of an equipment cabinet according to embodiments.

As shown in FIG. 1, the blower enclosure 102 may include the frame 119, and one or more panels 119P coupled to the frame 119. The panels may be partial or fully-closed sheets, or may include louvers, screens, or ducts thereon which may function as a least one air ingress/egress. In some embodiments, all the sides may include air ingress/egress. The blower enclosure 102 may include an air flow ring 102R in a bottom thereof. A cooled-equipment cabinet 1300 including the blower assembly 100 and equipment cabinet 1340 may be provided. The blower assembly 100 may be mounted on top of the equipment cabinet 1340 as is shown in FIG. 13 and may be operational to cool the devices and equipment housed therein. Because the motor and blower fan assembly 114 may weigh between about 70 pounds and 130 pounds, a lift of some sort may be required to change out the motor and blower fan assembly 114 from the enclosure. The motor and blower fan assembly 114 is vertically suspended below the blower mounting plate 112 of the slider subassembly 105. As such, once unbolted and thus disconnected from the slider rails 106A, 106B, the assembly of the blower mounting plate 112 and motor and blower fan assembly 114 may be easily lifted slightly from the blower anchor plate 117 and removed by moving in the direction of arrow 1342. Installation is in the reverse.

FIGS. 3-6 illustrate another embodiment of blower assembly 300 wherein the blower enclosure 302 comprises multiple compartments. The number of compartments may comprise three compartments 345A, 345B, 345C as shown, for example. Other numbers of compartments may be used. Each compartment 345A-345C may include a blower slider assembly 304A-304C therein (the center slider assembly 304B shown retracted for service). Each blower slider assembly 304A-304C may be identical and may include a slider subassembly 305 as shown and described in FIGS. 7-11. Optionally, the blower slider assembly 104 of FIG. 1 may be used in each compartment 345A-345C.

In particular, a second a slider assembly 304B may be mounted next to a first slider assembly 304A and also mounted to the blower enclosure 302. The second slider assembly 304B may include slider rails 306A, 306B wherein each includes a moveable rail and a stationary rail, a blower mounting plate 312 coupled to each moveable rail of the slider rails 306A, 306B, and a second blower motor and fan assembly 114B mounted to the blower mounting plate 312 wherein the second blower motor and fan assembly 304B is adapted to slide out of the blower enclosure 302, like the first slider assembly 304A. A third slider assembly 304C may be mounted to the enclosure 302 adjacent to the second slider assembly 304B. Thus, each of the motor and fan assemblies 114A-114C may be easily serviced, as desired, by using the slider assemblies 304A-304C.

Figure 4:
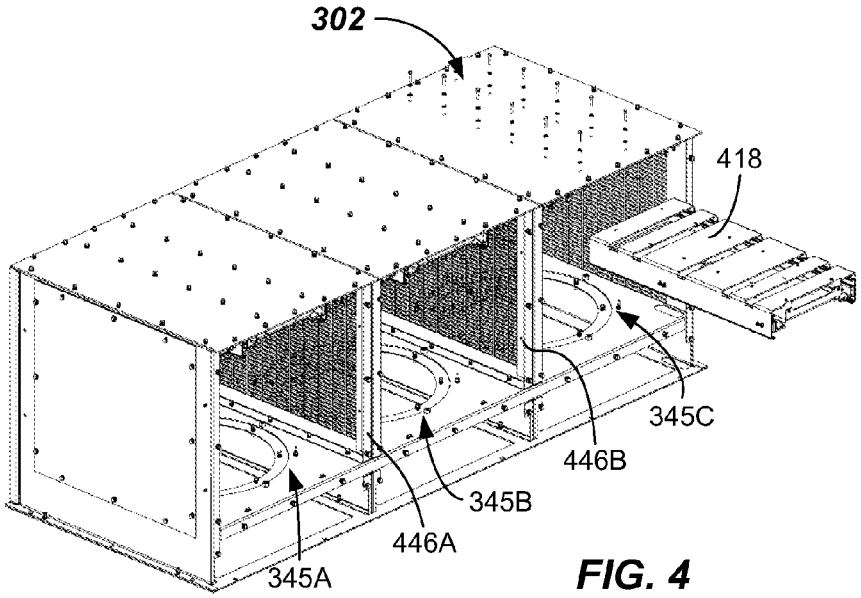
FIG. 4 illustrates a perspective view of a blower enclosure and rail anchor plate adapted for insertion and connection thereto according to embodiments.

FIG. 4 illustrates the blower enclosure 302 with the front cover frame removed and illustrates the compartments 345A-345C and compartment separators 446A, 446B, as well as a rail anchor plate 418 adapted to mount to the ceiling of the compartment 345C. Like rail anchor plates 418 may be mounted in compartments 345A, 345B.

Figure 5:
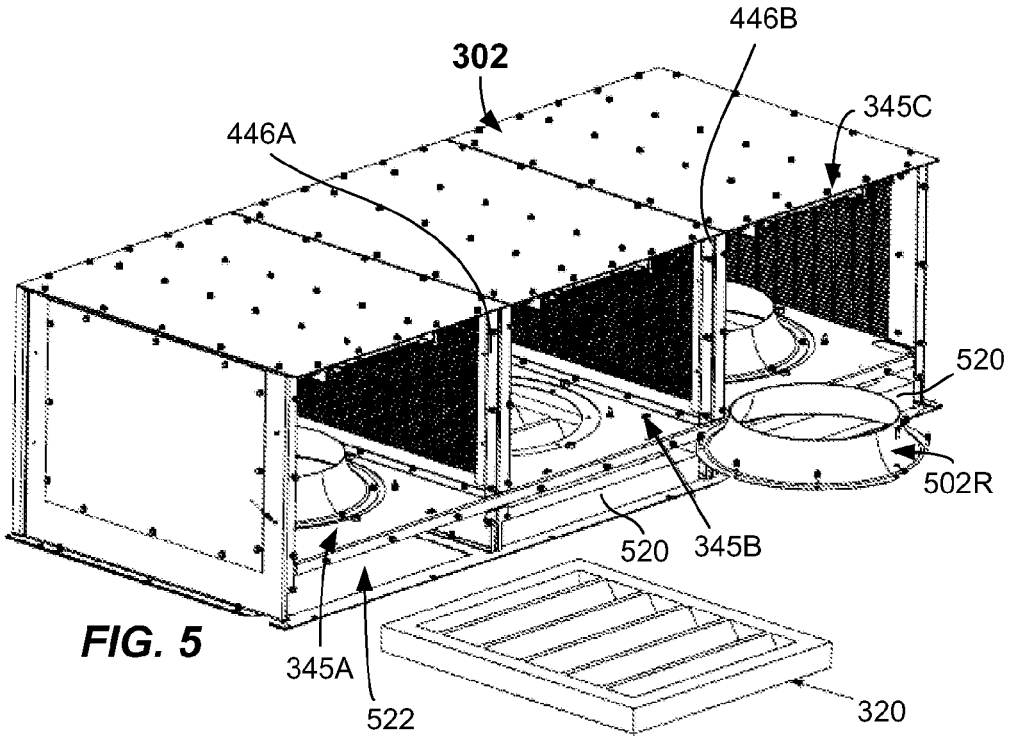
FIG. 5 illustrates a perspective view of a blower enclosure, and damper and air coupling ring adapted for insertion and connection thereto according to embodiments.

FIG. 5 illustrates the blower enclosure 302 with the front cover frame removed and illustrates the compartments 345A-345C and compartment separators 446A, 446B, as well as the air flow rings 502R adapted to mount to the partitions of the compartments 345A-345C. Dampers 520 may be mounted in channels 522.

Figure 6:
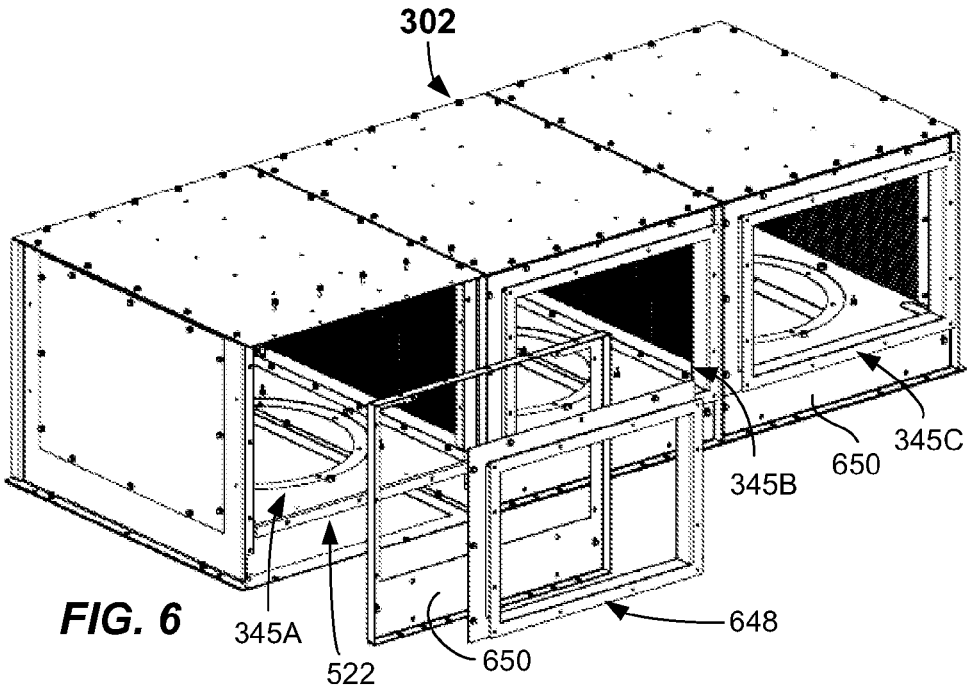
FIG. 6 illustrates a perspective view of a blower enclosure, and damper cover and louver frame adapted for insertion and connection thereto according to embodiments.

FIG. 6 illustrates the blower enclosure 302 with the front cover frames 648 installed and illustrates the compartments 345A-345C as well as the covers 650 for the damper channels 522. Ductwork, screens, or louvers may be mounted to the cover frame 648.

Figure 7:
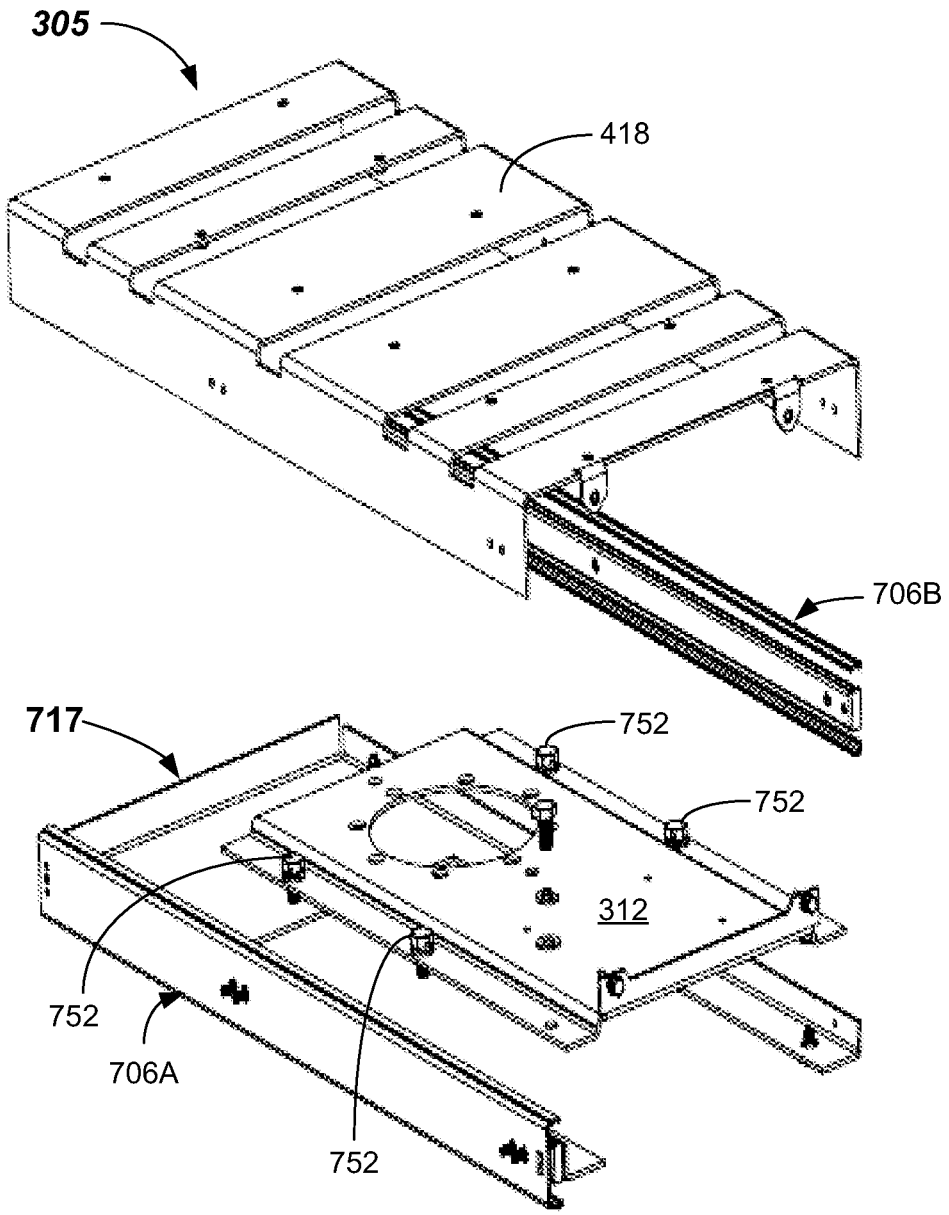
FIG. 7 illustrates an exploded perspective view of another embodiment of blower slider assembly according to embodiments.

FIG. 7 illustrates another embodiment of slider subassembly 305. Slider subassembly 305 includes a rail anchor plate 418 adapted to mount to a blower enclosure 302, a blower anchor plate 317, and a blower mounting plate 312 removably fastened to the blower anchor plate 717. The blower mounting plate 312 may be fastened to the blower anchor plate 717 by bolts 752 or the like. The slider subassembly 305 includes slider rails 706A, 706B (see also FIG. 11) that couple the blower anchor plate 717 to the rail anchor plate 418. Each slider rails 706A, 706B including a moveable rail and a stationary rail, as previously described. Each stationary rail is fastened to the rail anchor plate 418 at the sides thereof, and each moveable rail is fastened to the blower anchor plate 717. A blower motor and fan assembly (e.g., 304B) is mounted to the blower mounting plate 312 wherein the blower motor and fan assembly 114B is adapted to slide relative to the rail anchor plate 418.

Figure 8:
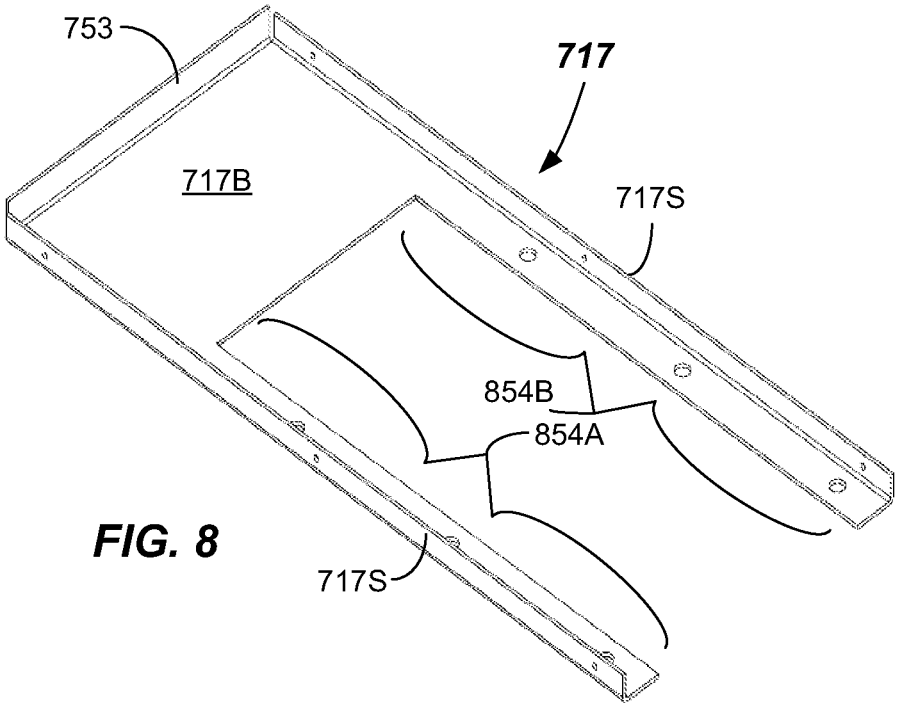
FIG. 8 illustrates a perspective view of a blower anchor plate according to embodiments.

As shown in FIG. 8, blower anchor plate 717 includes a base portion 717B and side portions 717S extending forward of the base portion 717B. The mounting plate 312 (FIG. 10) couples across portions 854A, 854B of the sides 717S. In the depicted embodiment, the safety catch comprises a bent flange 753 on the rear portion base portion 717B a blower anchor plate 717 that contacts tabs 955A, 955B extending from the front edge of the rail anchor plate 418. This limits an extent of sliding motion of the blower anchor plate 717, and thus the degree of sliding of the blower motor and fan assembly 114B.

Figure 9:
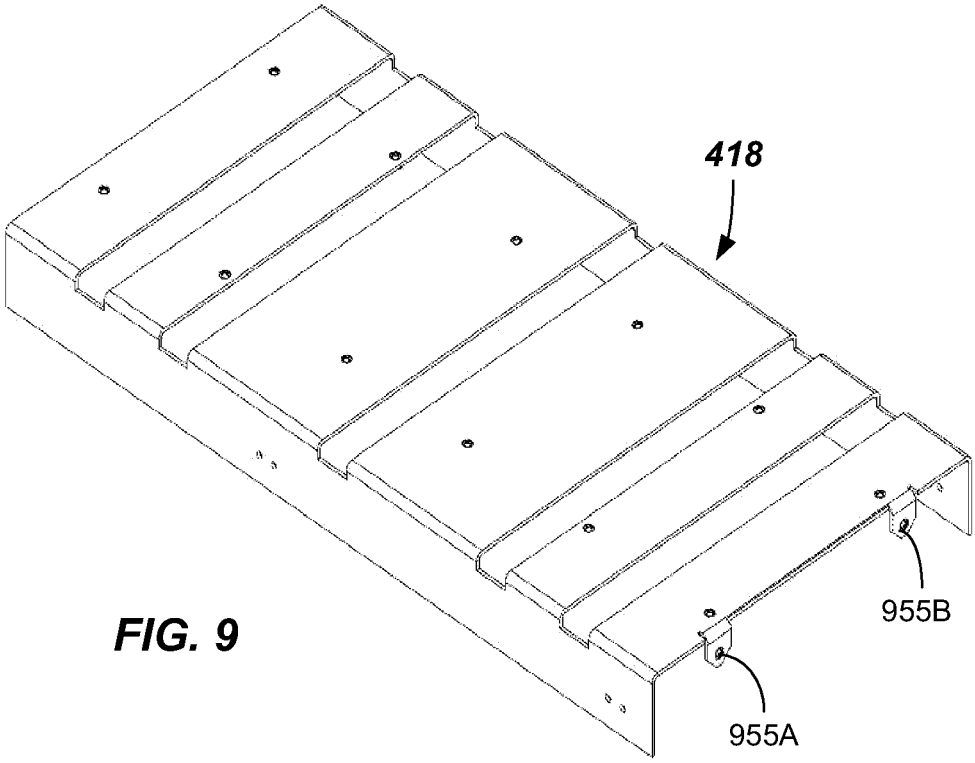
FIG. 9 illustrates a perspective view of a rail anchor plate according to embodiments.

As shown in FIG. 9, rail anchor plate 418 includes a top portion 418T with the tabs 955A, 955B extending from the front edge thereof. The tabs 955A, 955B are adapted to secure to security tabs 1016A, 10168 on the mounting plate (FIG. 10).

Figure 12:
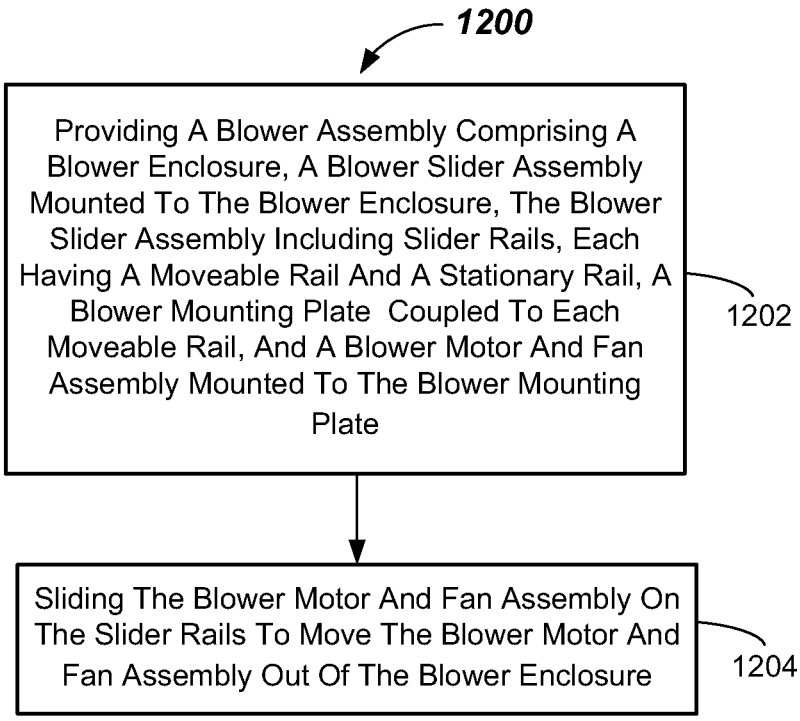
FIG. 12 illustrates a method of servicing a blower motor and fan assembly according to embodiments.

FIG. 12 illustrates a method 1200 of servicing a blower motor and fan assembly (e.g., 114). The method includes, in 1202, providing a blower assembly (e.g., blower assembly 100, 300) comprising a blower enclosure (e.g., blower enclosure 102, 302), a blower slider assembly (e.g., blower slider assembly 104, 304A-304C) mounted to the blower enclosure, the blower slider assembly including slider rails (e.g., slider rails 106A, 106B, 706A, 706B) each having a moveable rail and a stationary rail, a blower mounting plate (e.g., blower mounting plate 112, 312) coupled to each moveable rail; and a blower motor and fan assembly (e.g., blower motor and fan assembly 114, 114A-114C) mounted to the blower mounting plate. The method further includes, in 1204, sliding the blower motor and fan assembly on the slider rails to move the blower motor and fan assembly out of the blower enclosure.

Persons skilled in the art should readily appreciate that the invention described herein is susceptible of broad utility and application. Many embodiments and adaptations of the invention other than those described herein, as well as many variations, modifications, and equivalent arrangements, will be apparent from, or reasonably suggested by, the invention and the foregoing description thereof, without departing from the substance or scope of the invention. For example, although described in connection with electrical enclosures, the invention may be applicable to other suitable types of enclosures where cooling is desired, and especially top mounted blower assemblies. Accordingly, while the invention has been described herein in detail in relation to specific embodiments, it is to be understood that this disclosure is only illustrative and presents examples of the invention and is made merely for purposes of providing a full and enabling disclosure of the invention. This disclosure is not intended to limit the invention to the particular assemblies, systems or methods disclosed, but, to the contrary, the intention is to cover all modifications, equivalents, and alternatives falling within the scope of the invention.

What is claimed is:

1. A blower assembly, comprising:

a blower enclosure;

a blower slider assembly mounted to the blower enclosure, the blower slider assembly includes slider rails each including a moveable rail and a stationary rail, a blower mounting plate coupled to each moveable rail of the slider rails;

a blower motor and fan assembly mounted to the blower mounting plate wherein the blower motor and fan assembly is adapted to slide out of the blower enclosure; and a rail anchor plate coupled to the blower enclosure;

wherein the rail anchor plate includes a top portion fastened to the blower enclosure, and anchor sides extending downward from the top portion, wherein the stationary rails are fastened to the anchor sides.

2. The blower assembly of claim 1, wherein each of the slider rails comprises a linear bearing.

3. The blower assembly of claim 1, comprising a catch operational to limit an extent of sliding of the blower motor and fan assembly.

4. The blower assembly of claim 3 wherein the catch comprises a bent flange on a blower anchor plate.

5. The blower assembly of claim 1, wherein the blower mounting plate is coupled to each moveable rail by a blower anchor plate.

6. The blower assembly of claim 5, wherein the blower mounting plate is removably bolted to the blower anchor plate.

7. The blower assembly of claim 6, wherein the blower anchor plate comprises a base portion, side portions, and a safety catch.

8. The blower assembly of claim 5, wherein the blower mounting plate or the blower anchor plate comprises one or more securing tabs adapted to secure the slider assembly in a closed and secured condition within the blower enclosure.

9. The blower assembly of claim 8, wherein the one or more securing tabs are adapted to secure the blower mounting plate or the blower anchor plate to a rail anchor plate.

10. The blower assembly of claim 1, comprising lifting provisions on the blower mounting plate.

11. The blower assembly of claim 1, wherein the blower motor and fan assembly is mounted to the blower mounting plate, and the blower mounting plate is positioned between the slider rails.

12. The blower assembly of claim 1, wherein the blower motor and fan assembly is mounted below the blower mounting plate.

13. The blower assembly of claim 1, comprising a motor housing of the blower motor and fan assembly is received through an aperture in the blower mounting plate.

14. The blower assembly of claim 1, wherein the blower enclosure includes a frame, one or more panels coupled to the frame, at least one air ingress/egress, and an air flow ring in a bottom of the blower enclosure.

15. The blower assembly of claim 1, wherein the blower enclosure comprises:

a second a blower slider assembly mounted to the blower enclosure, the second blower slider assembly includes slider rails each including a moveable rail and a stationary rail, a blower mounting plate coupled to each moveable rail of the slider rails; and a second blower motor and fan assembly mounted to the blower mounting plate wherein the blower motor and fan assembly is adapted to slide out of the blower enclosure.

16. The blower assembly of claim 1, comprising a disconnect adapted to disconnect an electrical connection to the blower motor and fan assembly.

17. A blower slider assembly, comprising:

a rail anchor plate adapted to mount to a blower enclosure;

a blower anchor plate;

a blower mounting plate removably fastened to the blower anchor plate;

slider rails each including a moveable rail and a stationary rail, each stationary rail fastened to the rail anchor plate, and each moveable rail fastened to the blower anchor plate; and a blower motor and fan assembly mounted to the blower mounting plate wherein the blower motor and fan assembly is adapted to slide relative to the rail anchor plate;

wherein a motor housing of the blower motor and fan assembly is received through an aperture in the blower mounting plate.

18. The blower slider assembly of claim 17, further comprising a catch operational to limit an extent of sliding of the blower motor and fan assembly.

19. The blower slider assembly of claim 17, wherein the blower mounting plate is coupled to each moveable rail by a blower anchor plate.

20. The blower slider assembly of claim 19, wherein the blower mounting plate or the blower anchor plate comprises one or more securing tabs adapted to secure the slider assembly in a closed and secured condition within the blower enclosure.

21. A method of servicing a blower motor and fan assembly, comprising:

providing a blower assembly, comprising a blower enclosure, a blower slider assembly mounted to the blower enclosure, the blower slider assembly including slider rails each having a moveable rail and a stationary rail, a blower mounting plate coupled to each moveable rail, a blower motor and fan assembly mounted to the blower mounting plate, and a rail anchor plate coupled to the blower enclosure, wherein the rail anchor plate includes a top portion fastened to the blower enclosure, and anchor sides extending downward from the top portion, wherein the stationary rails are fastened to the anchor sides; and sliding the blower motor and fan assembly on the slider rails to move the blower motor and fan assembly out of the blower enclosure.

* * * * *